33-255
8/18/87 XR 4,686,770 SR

United States Patent [19]

Aigner

[11] Patent Number: 4,686,770

[45] Date of Patent: Aug. 18, 1987

[54] MECHANICAL AIMING DEVICE FOR RIFLES

[75] Inventor: Friedrich Aigner, St. Valentin, Austria

[73] Assignee: Steyr-Daimler-Puch AG, Vienna, Austria

[21] Appl. No.: 821,027

[22] Filed: Jan. 21, 1986

[30] Foreign Application Priority Data

Jan. 22, 1985 [AT] Austria ..... 149/85

[51] Int. Cl.[4] ..... F41G 1/02

[52] U.S. Cl. ..... 33/257; 33/233; 33/253; 33/256

[58] Field of Search ..... 33/233, 234, 252, 257, 33/258, 261, 255, 253, 254, 244

[56] References Cited

U.S. PATENT DOCUMENTS

| | | | |
|---|---|---|---|
| 507,278 | 10/1893 | Latta | 33/256 |
| 561,360 | 6/1896 | Taylor | 33/253 |
| 737,677 | 9/1903 | Tansley | 33/253 |
| 805,770 | 11/1905 | Bassell et al. | 33/253 |
| 1,191,704 | 7/1916 | Johnson | 33/244 |
| 2,208,576 | 7/1940 | Garand | 33/254 |
| 2,356,182 | 8/1944 | Schaich | 33/257 |
| 2,585,933 | 2/1952 | Harvey | 33/256 |

*Primary Examiner*—Willis Little
*Attorney, Agent, or Firm*—Marmorek, Guttman & Rubenstein

[57] ABSTRACT

In a mechanical sighting device for rifles, the front sight (6) is adjustable vis-à-vis the rifle barrel (1) as to height and sidewardly. In order to enable a height- and a sideward-adjustment independently of each other, and to guarantee at the same time a sturdy construction to be operable in a simple manner, the carrier (3) is supported slewably about the rifle barrel (1), and there is provided a finger (2) affixed on the rifle barrel (1). In the carrier (3) there is supported a setting screw (11) which crosses at right angle the rifle barrel (1), or the swivel axis of the carrier (3), respectively, and is supported on the finger (2). The foresight (6) is screwed into a bore (5) radial to the swivel axis of the carrier (3).

10 Claims, 2 Drawing Figures

MECHANICAL AIMING DEVICE FOR RIFLES

Figure 1:
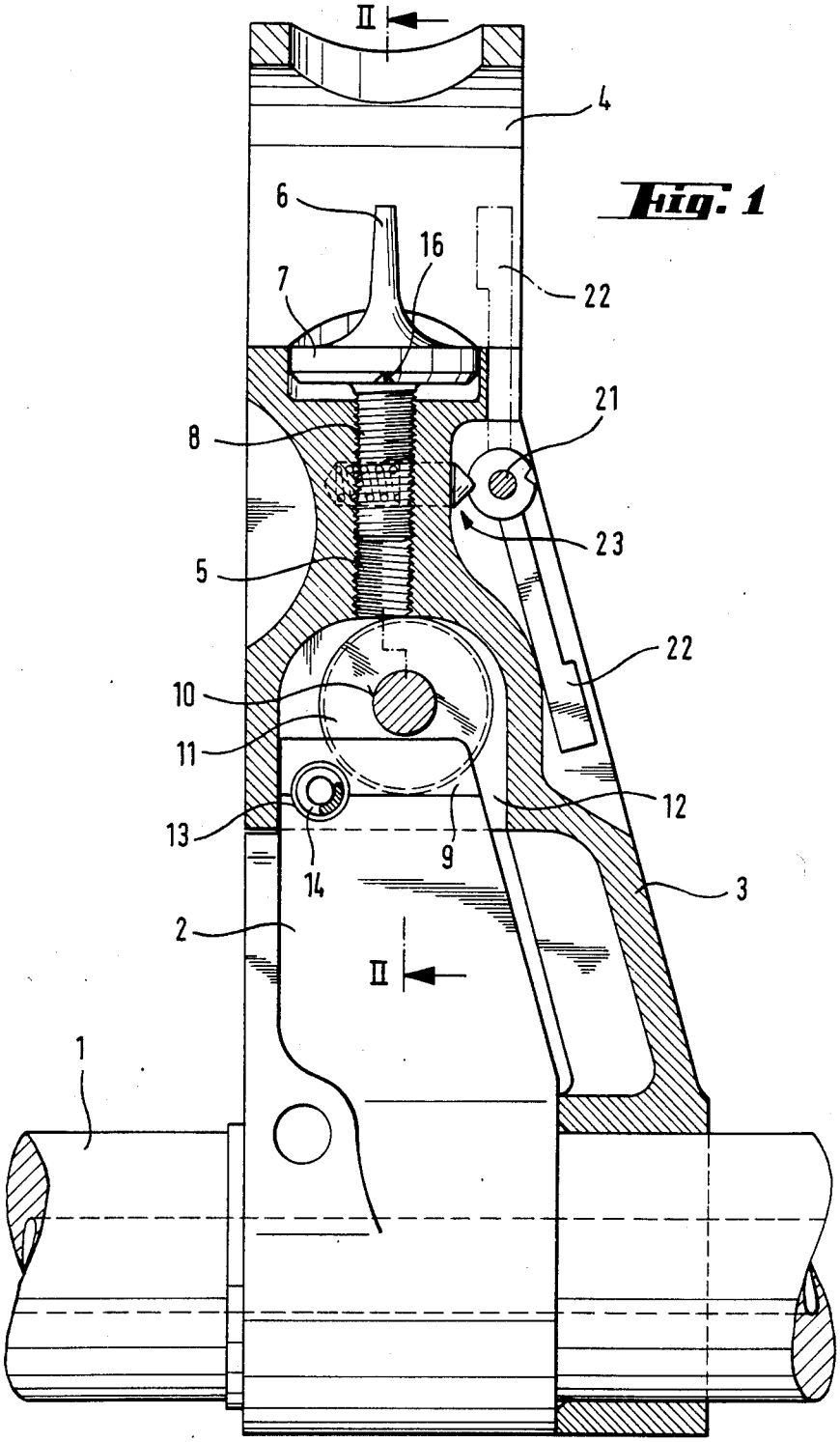

This invention relates to a mechanical sighting device for rifles, with a front sight mounted in a carrier and being adjustable vis-à-vis the rifle barrel as to height and sidewardly.

Such sighting devices are destined particularly for rifles having an exchangeable barrel, because, in such case, the rear sight can be fixedly, i.e., non-adjustably, arranged on the remaining rifle part upon removal of the barrel, and each barrel per se can contain a foresight adjusted in such a manner that, after assembly, there is always attained a correct future position. Indeed, the front sight must be appropriately adjusted on each barrel but, thereafter, it is no longer necessary to make a new adjustment after each barrel exchange. Of course, it can also be of advantage in other rifles if the front sight is adjustable with regard to height as well as sidewardly, or can be returned to the correct position after having been damaged.

Hitherto, this type of adjustment is achieved in a manner such that the front sight is provided with a stud bolt which can be screwed into a bore extending in the front sight carrier radially with regard to the barrel, however, it is not arranged coaxially with this stud bolt but is displaced sidewardly relative to the same. There results an eccentric, formed by the front sight and the stud, whose turning will result in the desired lateral adjustment of the front sight. As this also involves a turning of the stud screw in the threaded bore of the front sight support, a lateral displacement of the front sight is always connected, in an unfavorable manner, with a screwing into or out of the threaded bore, respectively, and thereby with a change in the height of the front sight. It is thus not possible to carry out a lateral adjustment and an adjustment of the height of the front sight independently of each other, so that each adjustment of the height is also connected with a displacement toward one or the opposite side. It is also felt to be a disadvantage of the known adjustability of the front sight that, when a preferably tunnel-shape front sight safeguard is present, the front sight will be brought into an asymmetrical position inside the front sight safeguard, whenever a lateral displacement becomes necessary, in which case the asymmetrical position of the front sight renders sighting more difficult because the marksman will always try spontaneously to align the front sight optically with the center, or the central line, respectively, of the front sight tunnel or the like.

The invention has therefore the task cf eliminating these drawbacks and to provide a mechanical sighting device of the initially described type which enables an adjustment of the height of the front sight without simultaneous lateral displacement, or, respectively, a lateral front sight displacement without noticeably changing the height of the front sight, and which affords a comparatively sturdy construction of the parts pertaining to the front sight which can be actuated in a simple manner.

The invention solves this task in a manner such that the carrier is slewable about the rifle barrel and there is provided, affixed on the rifle barrel, a finger on which there is supported, borne in the carrier, a setting screw whose axis intersects at a right angle the carrier swivel axis, with the front sight being screwed into a bore radial with regard to the swivel axis of the carrier which latter preferably constitutes a front side tunnel.

When the set screw is actuated, the carrier will be swivelled about the rifle barrel in one or the other direction, due to the fact that the setting screw is supported on the finger which is affixed on the rifle barrel. This swivel motion of the carrier affords the desired lateral displacement of the front sight, the swivelling amounting, however, only to an angle of a few degrees, so that the circular arc described by the tip of the front sight only deviates imperceptibly from a straight line, and, consequently, the occurring change of the height can be readily neglected. An adjustment of the front sight as to its height by screwing the sight more or less deeply into the radial bore of the carrier has, of course, no influence on the lateral position of the front sight, so that the displacement of the front sight as to height as well as sidewardly can be carried out completely independently of each other. As it is necessary in each case to actuate only one screw, the adjustment is a relatively simple one, and the entire construction does not comprise any parts that would require manufacturing with special precision or are liable to suffer from increased danger of being damaged. As the carrier itself constitutes the front sight tunnel, and as the front sight is simultaneously held in the same, fixed against lateral displacement, a swivelling of the carrier for the purpose of lateral front sight displacement will not displace the front sight from the center of the tunnel, so that no handicap to sighting results therefrom.

A particularly suitable construction is attained by designing the setting screw as a worm screw provided with a central annular groove which is engaged by a terminal bead on the finger, the carrier possessing a slot for passage of the finger therethrough into the bore for the setting screw.

In order to secure the adjusting device in the position desired at a given time, the setting screw is provided with peripheral lock-down recesses, and the pin-shaped front sight is broadened as a disk provided on its underside with lock-down recesses, bolt elements which are spread apart by spring action and engage the recesses of the setting screw and the disk being arranged in a common carrier bore extending parallel with the front sight axis. Therefrom results a simplification of the construction, in that only one common carrier bore and one common spring is provided for the bolt elements of the setting screw and the front sight disk.

In a further embodiment of the invention, there is provided a spring being supported on the finger in the slot region of the carrier and urging a flank of the annular groove of the setting screw against its end bead. By means of this spring, any inaccuracies of manufacture will be compensated and there is achieved a firm positioning of the carrier without play in spite of the unavoidable manufacturing tolerances.

Finally, the embodiment according to the invention offers the possibility of providing at the back side of the carrier a turn-up auxiliary foresight of a noctoviser. When turned up, this luminous auxiliary foresight is located in front of the front sight proper and thus enables the marksman to take an approximate aim in the poorest light, without the necessity of carrying a separate night front sight which would then have to be placed on the normal front sight. As the auxiliary front sight is mounted on the carrier it will automatically participate in a lateral adjustment of the front sight.

Figure 2:
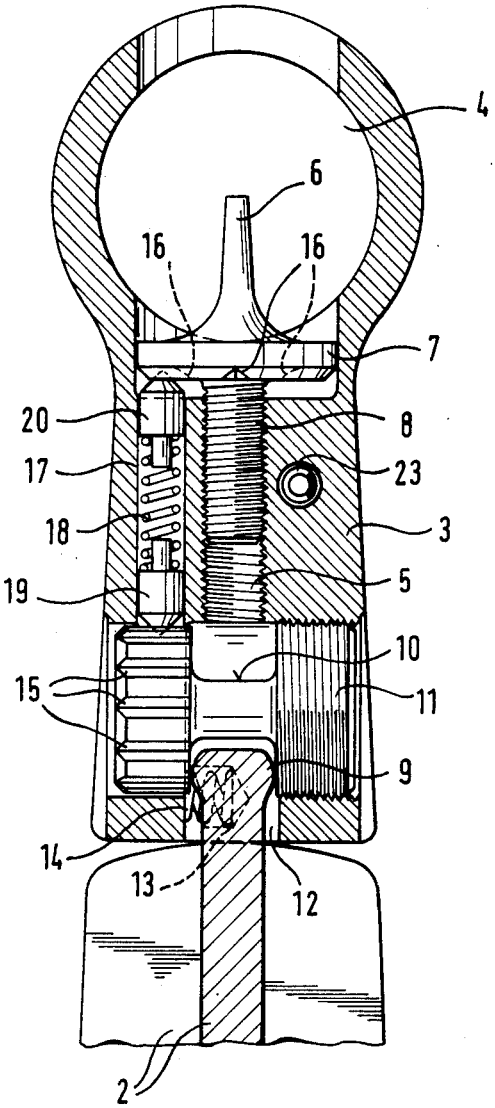

In the drawing there is illustrated an embodiment of the subject matter of the invention, and there are shown in FIG. 1 a forward part of a mechanical sighting device for a rifle having an exchangeable barrel, in partial section along a central plane extending through the rifle barrel axis, and in FIG. 2 a section along the line II—II in FIG. 1.

The forward part of the sighting device consists of a finger 2 firmly seated on the rifle barrel 1, and of a front sight carrier 3 being slewable about the barrel 1 which carrier forms a front sight tunnel 4 and is provided with a radial bore 5 into which the front sight 6 is screwed. The front sight 6 is broadened to comprise a disk 7 and bears a threaded stud 8 supported in the radial bore 5. The finger 2, in upright position, has an end bead 9 being rounded at its lateral flanks, by means of which bead it engages the central annular groove 10 of a setting screw 11 designed as a worm screw. The setting screw is supported in a carrier bore intersecting the swiveling axis of the carrier at right angle, while the carrier 3 is provided with a slot 12 for the passage therethrough of the finger 2 into the bore for the setting screw 11.

In a blind bore 13 of the finger 2 there is supported a pressure spring 14 which acts upon the sidewall of the slot 12 and urges the flank—on the right-hand side in FIG. 2—of the annular groove 10 of the setting screw 11 against the end bead 9 of the finger 2. In order to secure the positions of the setting screw 11 and the front sight 6, occupied at a given time, the setting screw is provided in its periphery with lock-down recesses 15, and the underside of the disk 7 is likewise provided with lock-down recesses 16. In a common carrier bore 17, parallel with the front sight axis, there are supported two bolt elements 19,20 being urged apart by a spring 18 and engaging in the lock-down recesses 15,16.

In order to attain a lateral displacement of the front sight 6, it is only necessary to turn the setting screw 11. As the same is supported at the end bead 9, it remains in place, while the carrier 3 carries out a corresponding swivel movement to one side or the opposite side. In order to achieve an adjustment as to height, the front sight 6 is screwed more or less deeply into the radial bore 5, by means of its threaded stud 8.

At the rear side of the carrier 3 there is mounted an auxiliary foresight 22 which can be turned up about an axis 21, which foresight is provided with a luminous layer and is turned up at poor lighting, covering or replacing the sight 6. A spring-equipped lock-down device 23 serves for securing the auxiliary foresight 22 in its two terminal positions.

I claim:

1. An adjustable sighting device for attachment to a rifle barrel, comprising a finger mounted on said rifle barrel, a front sight carrier connected to said finger, said front sight carrier including a front sight tunnel, said front sight carrier being slewable about a swivel axis, a setting screw provided within said front sight carrier for displacing said front sight carrier laterally in a portion of an arc about said swivel axis, said setting screw having an axis perpendicular to said swivel axis, a front sight disposed in said front sight tunnel, the height of said front sight being vertically adjustable by screwing said front sight into a bore in said front sight carrier, said bore being radial to said swivel axis, wherein the height and lateral displacement of said sighting device are adjustable independently of each other.

2. The device of claim 1 wherein said setting screw includes an annular groove and said finger includes a bead extending into said annular groove of said setting screw.

3. The device of claim 2 wherein said setting screw comprises a worm screw.

4. The device of claim 3 wherein said front sight carrier includes a slot for engagably receiving said finger.

5. The sighting device of claim 1, further comprising a set of lock-down recesses located on a periphery of said setting screw, and first engaging means insertable into said lock-down recesses for retaining said setting screw in a given position.

6. The sighting device of claim 5 wherein said front sight includes a disk, said disk including a set of lock-in recesses, and wherein said sighting device further comprises second engagement means insertable into said lock-in recesses for retaining said front sight in a given vertical position.

7. The sighting device of claim 6 wherein said first and second engagement means comprise first and second bolt elements, said first and second bolt elements being disposed in a common carrier bore in said front sight carrier, said first and second bolt elements being resiliently urged apart into said lock-down recesses and said lock-in recesses respectively.

8. The sighting device of claim 4, further comprising a spring provided in the region of said slot of said front sight carrier, said spring urging a flank of said annular groove of said setting screw against said bead.

9. The sighting device of claim 1, further comprising an auxiliary foresight rotatably mounted on a rear portion of said front sight carrier.

10. The sighting device of claim 9, wherein said auxiliary foresight comprises a night sighting device.

* * * * *